United States Patent [19]

Freelander et al.

[11] 4,280,715

[45] Jul. 28, 1981

[54] TOY SKI

[76] Inventors: Israel R. Freelander; Michael S. Freelander, both of 6 Spring Valley Dr., Worcester, Mass. 01609

[21] Appl. No.: 580

[22] Filed: Jan. 2, 1979

[51] Int. Cl.[3] ..... A63C 5/00; A63C 9/00

[52] U.S. Cl. ..... 280/623; 9/310 AA; 280/600; 280/601; 280/607

[58] Field of Search ..... 280/601, 600, 611, 623, 280/607; 9/310 AA, 310 A

[56] References Cited

U.S. PATENT DOCUMENTS

| | | | |
|---|---|---|---|
| 2,152,011 | 3/1939 | Zier | 280/600 |
| 2,382,149 | 8/1945 | Hartman | 9/310 AA |
| 2,920,331 | 1/1960 | Jahn et al. | 280/607 X |
| 3,127,623 | 4/1964 | Roubebush | 9/310 AA |
| 3,137,014 | 6/1964 | Meucci | 9/310 AA |
| 3,261,071 | 7/1966 | Roley | 9/310 AA |
| 3,839,758 | 10/1974 | Jack | 9/310 AA |
| 3,854,745 | 12/1974 | Puchtler | 280/619 |

*Primary Examiner*—Randolph A. Reese
*Assistant Examiner*—Milton L. Smith
*Attorney, Agent, or Firm*—Salter & Michaelson

[57] ABSTRACT

An inexpensive toy ski including an integral, upstanding heel rest and a separate toe clamp longitudinally adjustable to a number of different selected positions with respect to the heel rest such that adjustment may be readily viewed by the child or other person utilizing the ski while simultaneously providing a strong heel rest. Opposite sides of the ski in front of the heel rest are provided with a pair of laterally spaced upstanding side bars which in turn are provided with a plurality of aligned spaced openings so as to receive headed projections laterally extending from the toe clamp and thus provide the means by which the toe clamp is secured to the ski and longitudinally adjustable with respect thereto.

4 Claims, 5 Drawing Figures

TOY SKI

BACKGROUND AND SUMMARY OF THE INVENTION

This invention relates to skis and more particularly to an inexpensively produced toy snow ski designed for primary use by a child. Many ski constructions include a foot binder having a fixed front foot portion into which the person's foot is initially thrust and a heel portion thereafter adjusted into comfortable contact with the wearer's foot to provide a secure attachment of the ski to the foot. Examples of such ski constructions are shown in the following U.S. Pat. Nos. 2,382,149 issued Aug. 14, 1945, 3,127,623 issued Apr. 7, 1964, 3,137,014 issued June 16, 1964, 3,261,041 issued July 19, 1966, and 3,839,758 issued Oct. 8, 1974. Such constructions, however, are not suitable for an inexpensively produced ski intended primarily for use by children. These constructions furthermore do not enable an unsophisticated user to easily visually observe the final extent of the opening into which his or her foot will be placed nor are such constructions practical in making a low-cost product intended as a toy or sport introduction aid.

It is accordingly an object of the present invention to provide a ski of low-cost construction which is both of adequate strength to withstand normal use and is particularly simple to operate and thus has particular utility for children or as an adult toy.

These and other objects of the present invention are accomplished by a ski having an elongated body portion which includes a heel rest rigidly fixed to and preferably integral with said body portion and upstanding therefrom. A pair of spaced side bars are positioned forwardly of the heel rest and project upwardly from the upper surface of the ski body portion and are also preferably integrally formed therewith. A separable toe clamp having projections outwardly laterally extending therefrom is adapted for positioning forward of the heel rest in a number of alternate positions so as to provide effective length adjustability such that the ski will accommodate the various size feet of different users. The toe clamp projections are temporarily received in selected openings in turn provided in the upstanding side bars.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
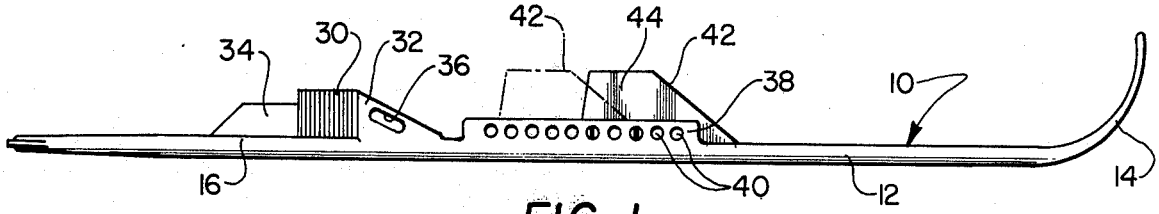
FIG. 1 is a side elevational view showing a ski constructed in accordance with the present invention.
Figure 2:
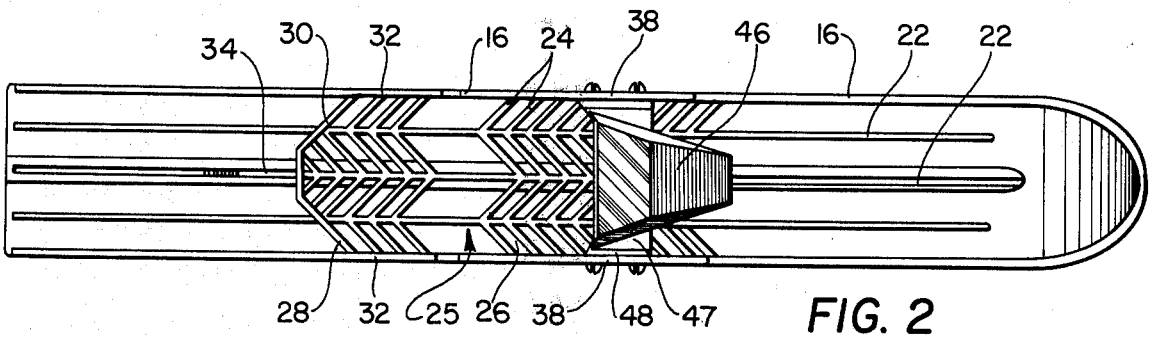
FIG. 2 is a top plan view thereof.
Figure 3:
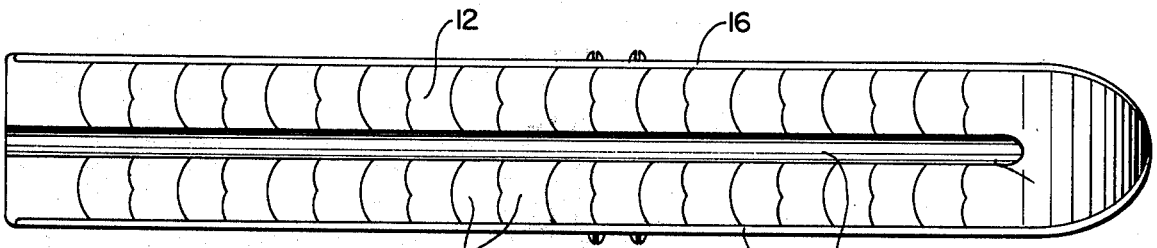
FIG. 3 is a bottom plan view thereof.
Figure 4:
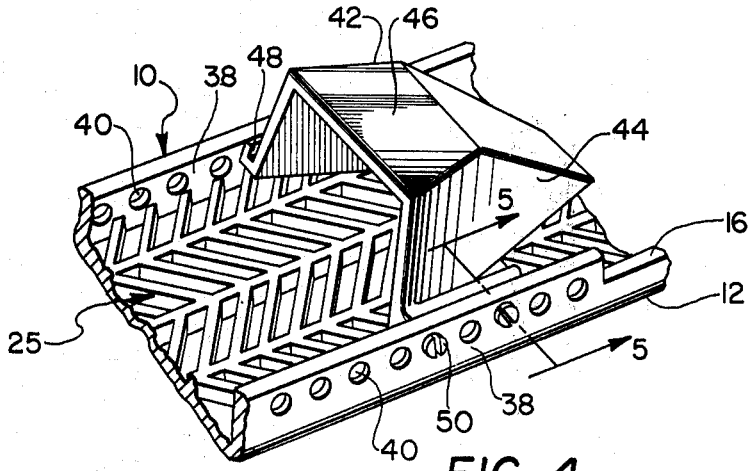
FIG. 4 is a partial perspective view showing the manner in which the toe clamp may be adjustably secured to the ski.
Figure 5:
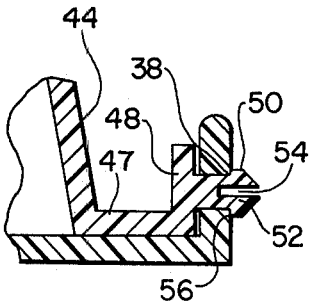
FIG. 5 is a sectional view taken along the line 5—5 of FIG. 4.

The construction of the present invention includes a ski 10 of generally conventional overall appearance and having an elongated generally flat body 12 with an upstanding front or plow portion 14. The ski 10 may be formed from conventional materials such as wood and the like, but is preferably formed by injection molding techniques from resinous plastic materials including polyolefin compositions such as polyethylene and the various polymeric blends thereof. The bottom surface of the ski includes vertically extending ribs 16 disposed at the ski edges as well as an upwardly extending groove 18. The bottom surface may also be provided with a series of stepped, scalelike segments 20. The ribs 16, the groove 18 and the segments 20 serve to minimize the lateral slide of the ski through snow and other supporting materials.

The top surface may also be provided with a series of longitudinally extending upwardly directed ribs 22 which serve to stiffen or otherwise impart rigidity to the ski as well as a plurality of upstanding ribs 24 interconnected with each other to form a general chevron pattern for generally the same purpose and to additionally form a generally planar surface or section 25 for contact with the foot of the person using the ski. The chevron patterned ribs are accordingly generally positioned central to the ski and are separated from each other so as to provide intermediate spaces 26 therebetween so that snow and the like will not likely form a slippery layer over the surface of the section 25.

Adjacent the central foot rest section 25 and forming the rear boundary thereof, a heel rest 28 is disposed. Such heel rest is preferably formed integral with the ski and includes a generally U-shaped upstanding rear wall 30 and sidewalls 32 which are generally and preferably coextensive with the side edges 16 of the ski 10. A brace or support 34 of general fin-like construction is additionally integrally molded with the back wall 30 of the upper surface of the ski such that rearward force transmitted to the back wall 30 by the wearer's foot during use will not rearwardly deflect such wall. The sidewalls 32 are furthermore provided with elongated enclosed slots 36 for receipt of a strap (not shown) such that the foot of the wearer may, if desired, be bound to the ski in a known manner.

The forward end of the foot rest section or platform is provided with a pair of laterally spaced side bars 38 upwardly extending from the upper surface of the ski and preferably coextensive with the side ribs 16 thereof. Each of the side bars 38 is provided with a plurality of laterally disposed openings 40 which are longitudinally aligned and spaced from each other. The openings 40 of each side bar 38 are also generally laterally opposed to each other and form part of the means by which a toe clamp 42 may be mounted with respect to the ski in a number of preselected positions such that various foot lengths may be accommodated by the ski.

The toe clamp is of overall shell-like construction and includes generally trapezoidally shaped side walls 44 and a connecting top wall 46 which narrows towards the front end thereof so as to accommodate the normal configuration of the toe portion of a user of the ski. Each of the sidewalls 44 further includes a laterally extending flange 47 which in turn terminates in an upstanding wall 48 adapted for face-to-face disposition with the interior portions of respective side bars 38. Each of the walls 48 further includes a pair of laterally extending projections 50 having an enlarged head 52 further provided with a central slot 54. Each projection head accordingly is divided into opposed segments each in turn exhibiting a shoulder 56 and so as to enable the radial extent thereof to be temporarily reduced by flexible compression of the headed sections towards each other. Such compression enables the projections to pass through the openings 40 and to expand on the other side thereof such that the shoulders 56 contact the outer surface of the side bars 38, thus locking the toe clamp 42 into the desired position. This provides a positive and adjustable mechanism for adjusting the size of the foot opening and one which is readily visible as by child users of the ski. Such construction also prevents the necessity of the adjustable portion of the foot binder receiving the maximum force or shock during use of the ski, such as in the case of the prior art devices above discussed.

While there is shown and described herein certain specific structure embodying the invention, it will be manifest to those skilled in the art that various modifications an rearrangements of the parts may be made without departing from the spirit and scope of the underlying inventive concept and that the same is not limited to the particular forms herein shown and described except insofar as indicated by the scope of the appended claims.

What is claimed is:

1. A toy ski comprising a longitudinally oriented body portion having a generally planar upper surface section adapted to receive the foot of a skier, a heel rest rigidly fixed to said body portion and upstanding therefrom and positioned adjacent to the rear of said foot receiving section, a toe clamp for receipt of the toe portion of the foot of the skier disposed forwardly of said heel rest and adjacent to forward portions of said foot receiving section, means for mounting said toe clamp on said body portion for longitudinal reciprocal adjustment relative to said heel rest, said mounting means including laterally spaced side bars upstanding from said body portion disposed forwardly of said heel rest, said side bars each having a plurality of longitudinally spaced, laterally directed openings adapted to receive at least one projection laterally extending from opposite sides of said toe clamp, said toe clamp of generally shell-like configuration, a flange laterally outwardly extending from the opposite sides of said toe clamp and terminating in an upwardly extending wall, said projections outwardly extending from said walls.

2. A toy ski as claimed in claim 1, each of said walls adapted for face-to-face contact with a respective side bar inner surface.

3. A toy ski comprising a longitudinally oriented body portion having a generally planar upper surface section adapted to receive the foot of a skier, a heel rest rigidly fixed to said body portion and upstanding therefrom and positioned adjacent to the rear of said foot receiving section, a toe clamp for receipt of the toe portion of the foot of the skier disposed forwardly of said heel rest and adjacent to forward portions of said foot receiving section, means for mounting said toe clamp on said body portion for longitudinal reciprocal adjustment relative to said heel rest, said mounting means including laterally spaced side bars upstanding from said body portion disposed forwardly of said heel rest, said side bars each having a plurality of longitudinally spaced, laterally directed openings adapted to receive at least one projection laterally extending from opposite sides of said toe clamp, said projections each having an enlarged head including a shoulder adapted to contact the outer surface portions of said bars adjacent said openings, said head in turn provided with an outwardly projecting slot separating said head into opposed segments inwardly flexible towards each other so as to permit said heads to pass through said openings.

4. A toy ski comprising an elongated body portion having a generally planar upper surface which terminates at the forward end thereof in a front upwardly turned plow portion, said planar upper surface being formed with a foot contact section having spaced side bars, the rearmost portion of said foot contact section including a heel rest joined thereto and extending upwardly therefrom, said heel rest being fixed against movement and having a configuration for snugly receiving a rounded heel of the shoe of the user, a toe clamp adjustably mounted on said foot contact section and spaced forwardly from said fixed heel rest, said toe clamp having a shell-like configuration for receiving the toe of the user and including side walls to which are joined outwardly extending portions, and means formed in the side bars of said foot contact section adjacent to said toe clamp for selectively engaging said outwardly extending portions, wherein the longitudinal position of said toe clamp relative to said fixed heel rest is selectively adjusted, said selectively engaging means including a plurality of longitudinally spaced openings into which the outwardly extending portions of said toe clamp are selectively located for adjusting the longitudinal position of said toe clamp relative to said heel rest, said toe clamp having laterally extending flanges joined to the side walls thereof, said outwardly extending portions being defined by a pair of laterally extending projections joined to said flanges and having a configuration for being received in selected openings in said side bars in snap fitting relation.

* * * * *